US007669646B2

(12) United States Patent
Aigner et al.

(10) Patent No.: US 7,669,646 B2
(45) Date of Patent: Mar. 2, 2010

(54) HEAT EXCHANGER WITH HEADER AND FLOW GUIDE

(75) Inventors: Herbert Aigner, Engelsberg (DE); Gabriele Engl, München (DE); Thomas Hecht, Gauting (DE); Helge Möbus, Oerlenbach (DE); Stefan Möller, München (DE); Wolfgang Süssmann, München (DE); Alfred Wanner, Deisenhofen (DE)

(73) Assignee: Linde Aktiengesellschaft, Munich (DE)

( * ) Notice: Subject to any disclaimer, the term of this patent is extended or adjusted under 35 U.S.C. 154(b) by 277 days.

(21) Appl. No.: 11/589,710

(22) Filed: Oct. 31, 2006

(65) Prior Publication Data

US 2007/0114014 A1 May 24, 2007

(30) Foreign Application Priority Data

Nov. 22, 2005 (DE) ..... 10 2005 055 676

(51) Int. Cl.
*F28F 9/02* (2006.01)

(52) U.S. Cl. ..... 165/174; 165/173

(58) Field of Classification Search ..... 165/148, 165/151, 153, 157, 158, 159, 160, 161, 162, 165/163, 172, 173, 174, 175, 176; 62/515
See application file for complete search history.

(56) References Cited

U.S. PATENT DOCUMENTS 1,344,351 A * 6/1920 Norelius et al. ..... 165/174
2,099,186 A * 11/1937 Anderegg ..... 165/151
3,516,483 A * 6/1970 Benteler et al. ..... 165/175
4,098,328 A * 7/1978 Cheong ..... 165/148
4,254,825 A * 3/1981 Imazu ..... 165/163
4,407,269 A * 10/1983 Hopper ..... 165/174
4,513,587 A * 4/1985 Humpolik et al. ..... 62/515
4,524,823 A * 6/1985 Hummel et al. ..... 165/174
4,576,222 A * 3/1986 Granata et al. ..... 165/159
5,186,249 A * 2/1993 Bhatti et al. ..... 165/174
5,284,203 A * 2/1994 Dauvergne ..... 165/174
5,415,223 A * 5/1995 Reavis et al. ..... 165/159
5,465,783 A * 11/1995 O'Connor ..... 165/174
5,651,268 A * 7/1997 Aikawa et al. ..... 165/174
5,901,785 A * 5/1999 Chiba et al. ..... 165/174
6,199,401 B1 * 3/2001 Haussmann ..... 165/153
6,334,484 B1 * 1/2002 Kandel ..... 165/158
6,543,528 B2 * 4/2003 Saito et al. ..... 165/153
6,874,569 B2 * 4/2005 Gawthrop et al. ..... 165/174
7,051,798 B2 5/2006 Moeller et al.
7,222,501 B2 * 5/2007 Cho et al. ..... 62/515

(Continued)

FOREIGN PATENT DOCUMENTS

EP 1452817 9/2004

(Continued)

*Primary Examiner*—Ljiljana (Lil) V Ciric
(74) *Attorney, Agent, or Firm*—Cahn & Samuels LLP

(57) ABSTRACT

A plate heat exchanger includes a heat exchanger block having a plurality of heat exchange passages. On the heat exchanger block, a header is mounted that extends over at least one part of one side of the heat exchanger block and establishes a flow connection between the heat exchange passages. The plate heat exchanger is provided with a fluid connection, which is formed by the header-side end of a pipeline. The fluid connection is essentially perpendicular to the side of the heat exchanger block over which the header extends. Within the pipeline directly in front of the header, there is a flow guide.

13 Claims, 3 Drawing Sheets

U.S. PATENT DOCUMENTS

| | | | | |
|---|---|---|---|---|
| 7,275,394 | B2 * | 10/2007 | Lundberg | 62/515 |
| 7,461,687 | B2 * | 12/2008 | Han et al. | 165/174 |
| 2002/0066553 | A1 * | 6/2002 | Fischer et al. | 165/174 |
| 2005/0066524 | A1 | 3/2005 | Moeller et al. | |

FOREIGN PATENT DOCUMENTS

| | | |
|---|---|---|
| EP | 1471322 | 10/2004 |

* cited by examiner

HEAT EXCHANGER WITH HEADER AND FLOW GUIDE

BACKGROUND AND SUMMARY OF INVENTION

This application claims priority of German Patent Application No. 102005055676.0 filed Nov. 22, 2005, the disclosure of which is incorporated by reference in its entirety.

The present invention relates to a plate heat exchanger with a heat exchanger block that has a plurality of heat exchange passages. On the heat exchanger block, a header is mounted that extends over at least one part of one side of the heat exchanger block and establishes a flow connection between part of the heat exchange passages. The header is provided with a fluid connection located essentially perpendicular to the side of the heat exchanger block over which the header extends.

The heat exchanger block of a plate heat exchanger comprises several layers of heat exchange passages that are each bounded by separating sheets against one another. Terminal strips and cover sheets form the outer frame of the heat exchanger block. Within one layer, there can be other separating strips that separate the heat exchange passages from one another for different material flows.

The heat exchanger block comprising all of the loose components may be soldered in a soldering furnace so that all components are tightly connected to one another. Then, headers that are provided with a fluid connection may be welded on over the entry and exit openings of the heat exchange passages. The headers may be semi-cylindrical shells. The fluid connection may be formed by pipe fittings that are located in the semi-cylindrical jacket of the header opposite the entry and exit openings. The pipelines for the fluid flows to be supplied and withdrawn are connected to these pipe fittings.

Plate heat exchangers can be used for simultaneous heat exchange of many fluid flows by a suitable arrangement of separating strips. For each of the fluid flows, corresponding headers may be attached over the respective entry and exit openings of the heat exchange passages and can be provided with pipelines. The piping of the plate heat exchanger in this case becomes very complex and expensive.

The plate heat exchanger according to the present invention has a heat exchanger block with a plurality of heat exchange passages. The heat exchange passages can be divided into groups, with the heat exchange passages of one group being used to route a particular fluid flow. Above the entry and exit openings into the heat exchange passages of one group, headers are mounted in each case such that a flow connection between these passages is established.

The header, partially also referred to as a collector, covers one part of one side of the heat exchanger block and with it forms a closed space into which the entry and exit openings of one group of heat exchange passages discharge. According to the present invention, the header is provided with a fluid connection that is located essentially perpendicular to the side of the heat exchanger block over which the header extends.

From EP 1452817 A1, it is known to place the fluid connection (i.e., the opening of the header to the pipelines that deliver or withdraw the respective fluid flow) in a plane that is essentially perpendicular to the plane in which the corresponding entry and exit openings in the heat exchange passages are located. This means that the fluid connection is not located directly opposite the entry and exit openings.

This configuration of the headers and especially of the fluid connection makes it possible to provide fluid connections on the two opposing sides of the heat exchanger block. Often, it is even possible to configure the plate heat exchanger such that all fluid connections are located on the same side of the heat exchanger block. The pipelines for delivering and withdrawing the material flows that have been brought into heat exchange with one another therefore need no longer be routed around the heat exchanger block in a complex manner. The piping cost is greatly reduced. The header is used not only for distributing the supplied fluid flow to the heat exchange passages or for collecting the fluid emerging from the heat exchange passages, but also for delivering and withdrawing the corresponding fluid flows.

An object of this invention is to improve a plate heat exchanger of the initially mentioned type.

This object is achieved by a flow guide being located within a pipeline directly upstream from its end.

Within the framework of the present invention, it has been found that separation swirls that lead to an uneven distribution of flow in the passages can occur at the fluid connection, and thus at the transition between the pipeline and the header on the edge of the heat exchanger block. This uneven distribution can lead to reduced thermal performance and also to additional thermal stresses on the apparatus. According to the present invention, in the entry fitting, on the end of the pipeline on which the fluid connection is located, there is a flow guide. Surprisingly, such a relatively economical flow guide in the entry fitting makes it possible to keep the separation swirls away from the passages and to thus greatly improve the uniform distribution in the header.

The flow guide of the present invention is located "on the end of the pipeline." This may, but need not, mean that the flow guide extends to the end of the pipeline (i.e., up to the fluid connection). There may also be a short distance between the end of the flow guide that points toward the fluid connection and the fluid connection itself. This distance may be small compared to the length of the pipeline and is preferably much smaller than the diameter of the pipeline. In embodiments, this distance is preferably less than 100 mm, and more preferably less than 10 mm. If the pipeline is relatively short, the flow guide may also run over the entire pipeline or essentially the entire pipeline.

Preferably, the headers have a semicircular cross-section. In embodiments, the headers may comprise semi-cylindrical shells, which have proven their value as headers. In such a half-shell-shaped embodiment of the header, the fluid connection is located in one of the two semicircular base surfaces. For reasons of strength, it may be advantageous to orient the other of the base surfaces, not perpendicular to, but, for example, obliquely to the semi-cylindrical jacket.

The present invention can also be used for plate heat exchangers with several heat exchanger blocks. The heat exchanger blocks may be connected to one another in the manner described in EP 1 452817 A1 and EP 1471322 A1. See U.S. Pat. No. 7,051,798 B2 and U.S. Patent Application Publication US 2005/0066524 A1, the disclosures of which are incorporated by reference in their entireties. Alternatively to the connection of the headers of two blocks by a semi-cylindrical pipeline, a connection of heat exchanger blocks can be made by a solid pipe (e.g., a cylindrical pipeline). In this case, it is also advantageous to use a flow guide according to the present invention in the connecting line, especially in the form of a flat plate that leads from the edge of the first block to the edge of the second block, optionally with small gaps between the plate and channels.

According to the present invention, the flow guide may assume any suitable shape and may comprise, for example, a curved plate. It is preferable, however, in terms of production engineering if the flow guide comprises at least one flat plate. In embodiments, the flow guide may comprise a single plate or two or more flat plates that are connected to one another. When there is a plurality of flat plates, the flat places are preferably tilted against one another.

Preferably, the at least one flat plate forming the flow guide has openings, 23*a* (FIG. 2*a*). In the simplest case, the flow guide comprises a single, flat perforated plate, 23*b* (FIG. 2*b*).

Alternatively, the plate or the at least one flat plate is solid, without perforation or without significant perforation (i.e., the free perforation cross-section is less than 20%, preferably less than 10%).

In embodiments, a flow guide facing the heat exchanger block may comprise a plate that ends on one edge of the heat exchanger block or in its vicinity, and the center axis of the pipeline may run through the block-side end of the flow guide. Accordingly, the formation of separation swirls on the edge of the block may be effectively prevented.

Here, "in the vicinity" means that the distance between the block-side end of the plate and the edge of the block is smaller than the diameter of the pipeline, for example, less than 100 mm, preferably less than 10 mm.

The present invention and other details of the invention are explained in more detail below using embodiments that are shown schematically in the drawings.

DETAILED DESCRIPTION OF THE INVENTION

Figure 1:
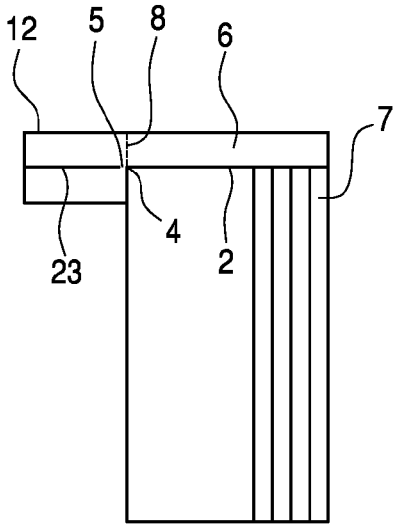
FIG. 1 shows a side view of a first embodiment of a heat exchanger according to the present invention with a header and a pipeline.
Figure 2:
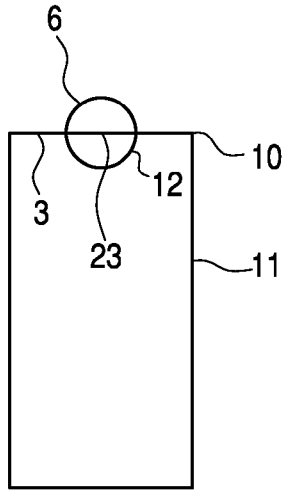
FIG. 2-2*b* show side views perpendicular to the view of FIG. 1 of a heat exchanger according to the present invention with a header and a pipeline.
Figure 2A:
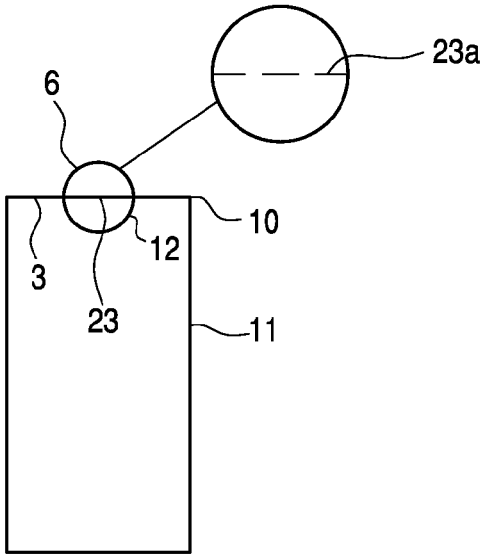
Figure 2B:
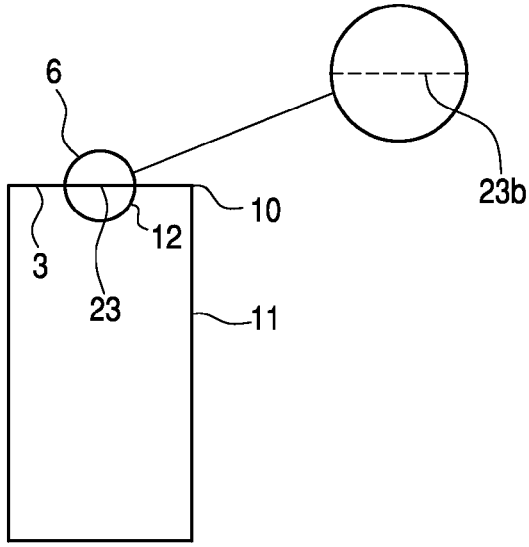

FIGS. 1 and 2 schematically show a plate heat exchanger in two directions of viewing that are perpendicular to one another. In the embodiment, the plate heat exchanger has one heat exchanger block 1 with a plurality of heat exchange passages 7 (for the sake of clarity only some of heat exchange passages are shown). The entry openings of one group of heat exchange passages are located in the area 2 of the top wall 3 of the heat exchanger block 1. A semi-cylindrical header 6 is welded to the top wall 3 and overlaps the entry openings. Of course, the heat exchanger block may have other headers and entry and exit openings not shown in the drawings. In embodiments, the header 6 may also be located along one edge 10 and/or on one wide side 11 of the block 1.

The header 6 may comprise a semi-cylindrical shell with a base surface 8. The base surface 8 comprises the "fluid connection." At this point, the header 6 is connected to a pipeline 12 via which in operation the fluid that is to be delivered into the heat exchange passages flows from the left. The pipeline 12 continues to the left beyond the edge of FIG. 1. The pipeline 12 is tightly connected to the header 6 so that the inflowing fluid flows via the pipeline 12 through the open base surface 8 into the header 6 and is distributed in the header 6 among the corresponding heat exchange passages of the block 1.

According to the present invention, within the cylindrical end piece of the pipeline 12 that is shown in the drawings, a flow guide is arranged as guide sheet 23. The guide sheet 23 can be formed by, for example, a flat metal sheet.

In the example from FIG. 1, the guide sheet 23 is located on the cylindrical axis of the pipeline and is parallel to the surface 3 of the heat exchanger block 1. Therefore, guide sheet 23 runs directly to the edge 4 of the block 1. In contrast to the representation in FIG. 1, the end of the guide sheet 23 can be welded onto the block. Preferably, however, a small gap 5 of less than 100 mm, preferably less than 10 mm, remains (for example, roughly 5 mm in width between the edge of the guide sheet and the block). In FIG. 2, the guide sheet lies exactly in front of the top edge of the heat exchanger block 1 in the region 2 and is therefore not actually visible.

Figure 3:
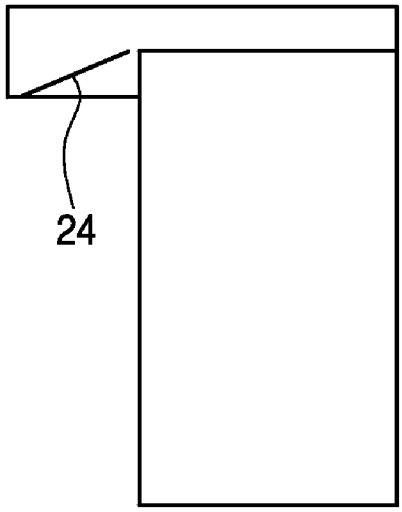
FIG. 3 shows a second embodiment of a heat exchanger block according to the present invention.
Figure 4:
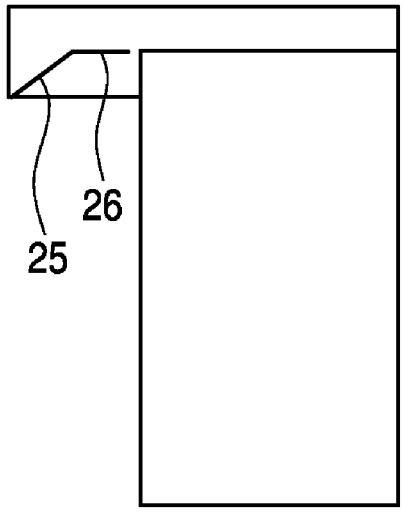
FIG. 4 shows a third embodiment of a heat exchanger block according to the present invention.

The guide sheet can also have other shapes, and its block-side end in all cases should end on or in the vicinity of the edge 4. Examples of differently-shaped flow guides are shown in the other drawings. FIG. 3 shows an individual plate 24 that is tilted relative to the axis of the pipeline. FIG. 4 shows two plates 25, 26 that are tilted against one another and that are connected to one another on one edge. Of course, the two plates 25, 26 can be made from a single workpiece, for example, by edging.

Figure 5:
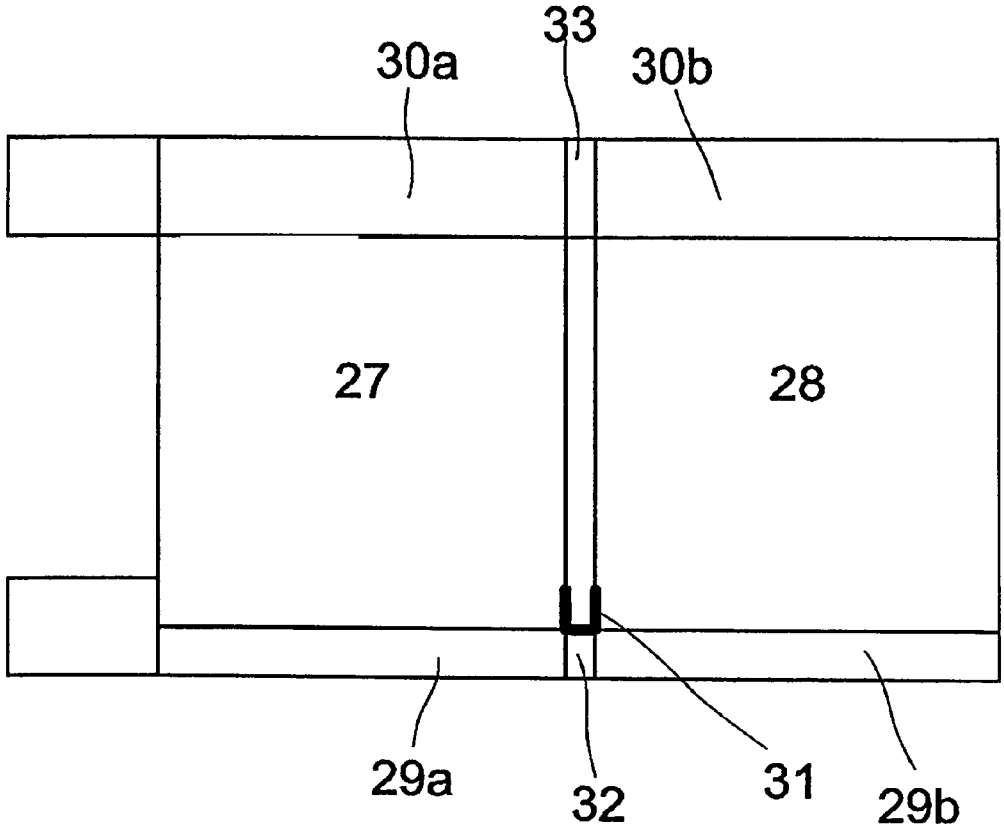
FIG. 5 shows a fourth embodiment having two heat exchanger blocks according to the present invention.

The present invention can also be used for plate heat exchangers with at least two heat exchanger blocks 27, 28 as shown in FIG. 5. Headers 29*a*, 29*b*, 30*a*, 30*b* establish a flow connection between heat exchange passages of the two or more heat exchanger blocks. The two or more heat exchanger blocks may be located next to one another, spaced apart. A gap between the two or more heat exchanger blocks may be sealed by a sheet or a strip 31 such that the side of the headers 29*a*, 29*b* facing the heat exchanger blocks is completely covered by side surfaces of the heat exchanger blocks 27, 28 and/or the sheet or the strip 31. An adapted intermediate piece 32, 33 may be inserted in each case between the headers of the two heat exchanger blocks.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A plate heat exchanger, comprising:

a heat exchanger block having a plurality of heat exchange passages;

a header mounted on the heat exchanger block, said header extending over at least one part of one side of the heat exchanger block and establishing a flow connection between the heat exchange passages;

a fluid connection comprising a pipeline, said fluid connection being located essentially perpendicular to the side of the heat exchanger block over which the header extends, and said pipeline being located externally relative to the header; and, a flow guide within the pipeline said flow guide comprising at least one flat plate and being located axially within the pipeline.

2. A plate heat exchanger according to claim 1, wherein the header has a semicircular cross-section.

3. A plate heat exchanger according to claim 1, wherein the at least one flat plate comprises a single flat plate.

4. A plate heat exchanger according to claim 1, wherein the at least one flat plate comprises at least two flat plates that are tilted toward one another.

5. A plate heat exchanger according to claim 1, wherein the at least one flat plate has openings.

6. A plate heat exchanger according to claim 1, wherein the at least one flat plate is solid.

7. A plate heat exchanger according to claim 1, wherein a distance between the at least one flat plate and the heat exchanger block is less than 100 mm.

8. A plate heat exchanger according to claim 1, wherein a distance between the at least one flat plate and the heat exchanger block is less than 10 mm.

9. A plate heat exchanger according to claim 1, wherein the at least one flat plate is preforated.

10. A plate heat exchanger according to claim 1, wherein the flow guide is parallel to a surface of the heat exchanger block.

11. A plate heat exchanger, comprising:

a heat exchanger block comprising a plurality of heat exchange passages;

a semi-cylindrical header mounted on a top wall of the heat exchanger block and overlapping the heat exchange passages;

a pipeline connected to the header for delivering fluid to the heat exchange passages and located externally of the semi-cylindrical header; and a flow guide comprising a flat plate located axially within the pipeline and in front of the header, wherein a distance between the flow guide and the heat exchanger block is less than the diameter of the pipeline.

12. A plate heat exchanger according to claim 11, wherein the flow guide is parallel to a surface of the heat exchanger block.

13. A plate heat exchanger according to claim 11, wherein a distance between the plate and the header is less than 100 mm.

* * * * *